US005822812A

United States Patent [19]

Worthington et al.

[11] Patent Number: 5,822,812

[45] Date of Patent: Oct. 20, 1998

[54] REMOTE OPERATED PLUG

[75] Inventors: Albert Edward Worthington; Cavan John O'Connell, both of Christchurch; Wayne Andrew Mason, Dunedin, all of New Zealand

[73] Assignee: Wes Wastes Limited, ChristChurch, New Zealand

[21] Appl. No.: 726,460

[22] Filed: Oct. 4, 1996

[30] Foreign Application Priority Data

Jun. 19, 1996 [NZ] New Zealand ..... 286846

[51] Int. Cl.[6] ..... E03C 1/23

[52] U.S. Cl. ..... 4/689

[58] Field of Search ..... 4/688–693

[56] References Cited

U.S. PATENT DOCUMENTS 645,639 3/1900 Bunting ..... 4/690

1,980,250 11/1934 Baxter ..... 4/690

3,002,196 10/1961 Mackey ..... 4/689

*Primary Examiner*—Charles E. Phillips

*Attorney, Agent, or Firm*—Seed and Berry LLP

[57] ABSTRACT

The invention relates to an improved remotely operated plug assembly (13) of the type with a pop-up plug (13) and cabling (14), wherein the inter-engaging means and the means for retaining the plug (13) in the sink waste unit (11) and in the closed position are circumferential. This allows the free movement of fluid from the plug (13) to the sink waste unit (11). The improvement relates to the use of common elements for both the inter-engaging means and the retaining means so that the one movable pin (34) acts in both the inter-engagement of the plug (13) and the sink waste unit (11), and the retention of the plug (13) within the sink waste unit (11) and in the closed position.

10 Claims, 2 Drawing Sheets

REMOTE OPERATED PLUG

TECHNICAL FIELD

The present invention relates to improvements to the mechanism for the operation of remotely operated plugs for commercial or domestic baths, sinks or basins.

BACKGROUND ART

Remotely operated plugs to open and close plugs, drains and sinks are known. Most known systems require support means or releasing opening and closing means that are essentially situated under the plug and are centrally located within the drain of the sink or basin. Improvements over these methods can be found in PCT/NZ96/00031 in which an alternative assembly is disclosed. A problem with this assembly has been found in that the sink unit and drain both require two sets of holes, one for location of a pin for retaining the plug within the drain unit whilst in operation or whilst open or closed, the second being for the remotely activated pin (34) which is part of the mechanism to release the plug from the closed position and to retain the plug in the closed position, after the plug has been closed.

An object of the present invention is to combine these two mechanisms and simplify the operation of the plug.

SUMMARY OF INVENTION

The present invention provides an improved remotely operated plug assembly for a sink or basin with a drain, said plug assembly including:

a sink waste unit secured within said drain, which sink waste unit includes a drain pipe;

a plug movably and releasably secured within said drain, said plug spring means, and an inter-engaging means, said plug having a closed top and sides with holes formed therein, wherein said plug is movably secured within the drain by said inter-engaging means which permits vertical movement of said plug within said drain, between an opened and a closed position and vice-versa, but which does not permit the removal of said plug from said drain under ordinary operating conditions, and said spring means being to bias said plug to the open position, said open position being a position in which said holes are open to said sink or basin, and said closed position being a position in which said closed top is substantially flush with the top of said sink waste unit;

an opening mechanism to move the plug from the closed position to the open position, said mechanism being situated remotely from said drain and plug and connected by cabling to a retaining mechanism, said opening mechanism including an opening means to move and retain one end of said cabling;

a retaining mechanism, to keep said plug in the closed position, includes spring-biased means to release said retaining mechanism to allow said plug to move to the open position;

means to allow the plug to be physically removed from said drain and replaced therein; wherein the plug is capable of movement between an open and a closed position by manual depression of said plug, and between a closed and an open position by operation of said remotely placed opening mechanism to release the retaining mechanism via the cabling; and wherein said inter-engaging means and said retaining means have common elements which are circumferentially situated within said drain pipe or about said drain pipe.

The present invention further provides a plug for a sink or basin with a drain, said plug being remotely operated and being movably and releasably secured within a drain pipe, said sink waste unit including:

a plug with a closed top and sides with holes formed therein, said plug being movably secured within the drain by an inter-engaging means which permits vertical movement of said plug within said drain, between an opened and a closed position and vice-versa, but which does not permit the removal of said plug from said drain under ordinary operating conditions, and which incorporates spring means to bias said plug to the open position, said open position being a position in which said holes are open to said sink or basin, and said closed position being a position in which said closed top is substantially flush with the top of said sink waste unit;

an opening mechanism to move the plug from the closed position to the open position, said mechanism being situated remotely from said drain and plug and connected by cabling to a retaining mechanism, said opening mechanism including an opening means to move and retain one end of said cabling;

a retaining mechanism, to keep said plug in the closed position, includes spring-biased means to release said retaining mechanism to allow said plug to move to the open position;

means for enabling the plug to be physically removed from said drain and replaced therein; wherein the plug is capable of movement between an open and a closed position by manual depression of said plug, and between a closed and an open position by operation of said remotely placed opening mechanism to release the retaining mechanism via the cabling; and wherein said inter-engaging means and said retaining means have common elements which and are circumferentially situated within said drain pipe or about said drain pipe.

BRIEF DESCRIPTION OF THE DRAWINGS

By way of example only preferred embodiments of the present invention will be described in detail with reference to the accompanying drawings in which.

BEST MODE FOR CARRYING OUT THE INVENTION

Figure 1:
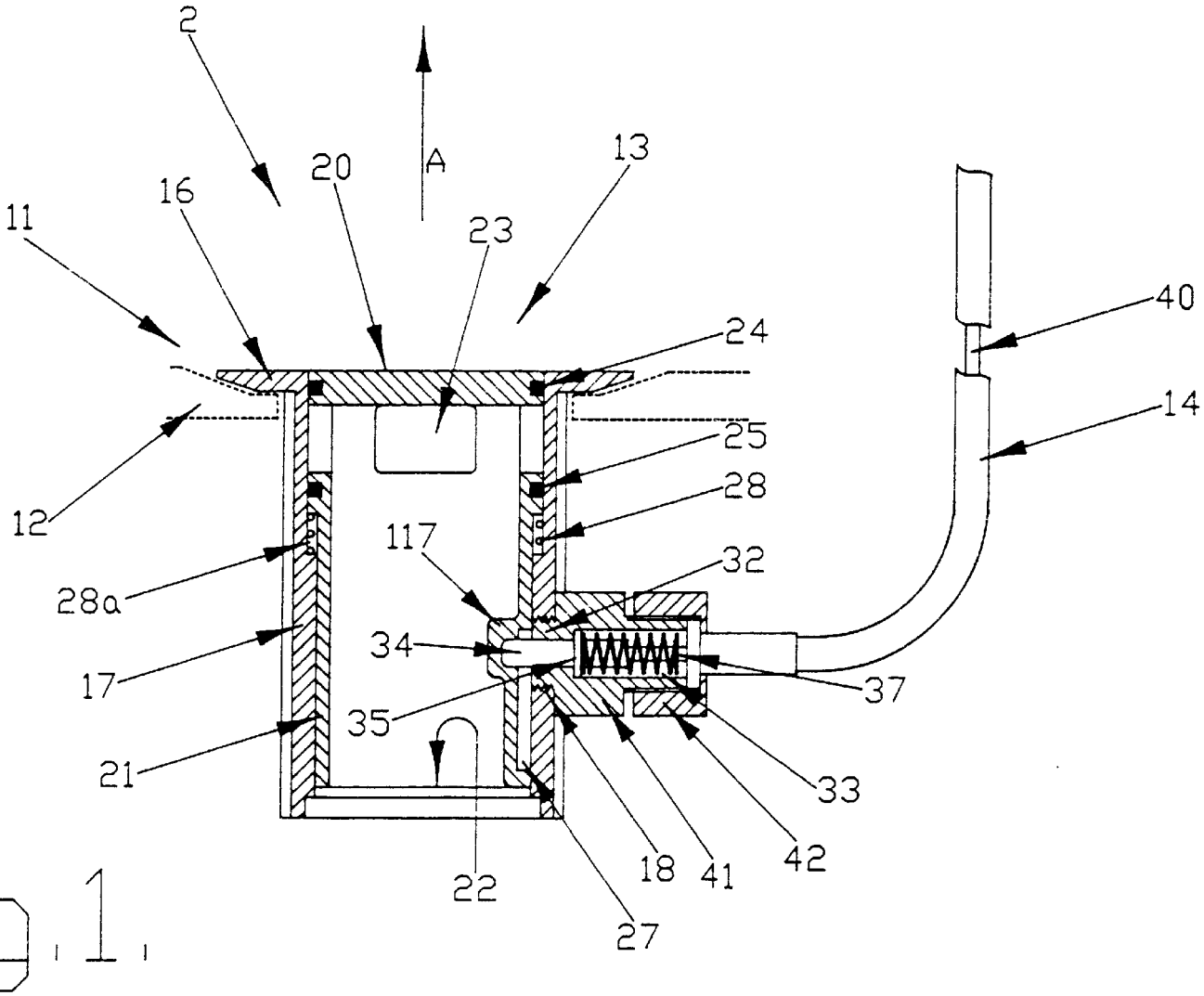
FIG. 1 is a section view of the plug end of a remotely operated plug showing a first preferred embodiment of the present invention, with the plug in the closed position.

Referring to the drawings, FIG. 1 shows a first preferred embodiment of the present invention which is part of a remotely operated plug 2. The elements of the remotely operated plug 2 incorporate a sink waste unit 11 fitting into the base of a standard basin or sink 12. The sink waste unit 11 incorporates a plug 13. The plug 13 is connected by cabling 14 to a remotely operating unit of known type.

The sink waste unit 11 is a standard type with a flange 16 which sits in a specially moulded portion of the sink 12 or slightly proud of the surface of the base 12 of the sink adjacent the opening for the drain. The cylindrical sides 17 forming a drain pipe of the sink waste unit 11 are screw-threaded on the outside, in known manner. The plug 13 incorporates a top 20, sides 21 and bottom 22. The outer portions of the sides 21, adjacent the top 20, are slotted with draining holes 23. The draining holes 23 may be of approximately rectangular or square shape. Alternatively, the holes 23 may be slots, sufficient for water to drain through. Positioned either side of the draining holes 23, on the circumference of the sides 21, are two O-rings 24, 25. O-rings 24, 25 are positioned in respective grooves, in order that they provide a seal between the sides 17 of the sink waste unit 11 and the sides 21 of the plug 13.

Thus waste water drains from the sink through holes 23, into the interior of the plug 13, and out the bottom 22 into the drain pipe below the plug 13.

A spring 28, of a diameter approximately equal to that of the plug 13 is positioned between the plug 13, and the sides 17 of the sink waste unit unit 11. With the plug 13 in the closed position, the spring 28 is tightly wound in a small cavity 28*a*. It will be appreciated that when the plug 13 is in the open position, that the size of the cavity 28*a* will be increased and the spring 28 will not be under such tension.

One side 17 of the plug 13 includes a screw-threaded hole 18. The hole 18 receives therein an externally screw-threaded collar 32. The collar 32 is formed integrally with or is permanently secured to a nut 41. Both the collar 32 and nut 41 are hollow internally to receive there through a pin 34. An additional end collar 42 (threaded onto nut 41) secures within the hollow a second spring 37. The second spring 37 operates within a chamber 33. A flanged end 35 of the pin 34 operates to retain the second spring 37 within the chamber 33. The second spring 37 operates against the inside of the nut 41 in addition to the flange 35 of the pin 34. The pin 34, nut 41, spring 37, chamber 33 and one end of cabling 14 forming a retaining mechanism to retain the plug 13 in the closed position.

The second end of the cable wire 40 (connected to the pin 34) is secured within the remote opening unit with an opening mechanism and opening means of known type.

The sink waste unit 11 intrudes on the side wall 21, on the interior thereof, a shaped additional portion 117 of the wall 21. This additional portion 117 protrudes slightly from the periphery of the interior of the plug 13 into the interior space. The portion 117 is shaped to have therein a hole of a complementary shape to the end of the pin 34. The section of the wall 21 below the additional portion 117 is thickened so that the internal dimensions of the lower portion of the plug 13, adjacent the bottom 22 is less than that adjacent the top 20. The thickened wall incorporates a slot 27 which does not extend through the entire thickness of the wall 21 but which incorporates access to the hole complementary to the shape of the end of the pin 34. The pin 34, hole 18 portion 117 with shaped hole and slot 27 form an inter-engaging means to permit vertical movement of the plug 13 within the sink waste unit 11.

The above described drain unit 2 works as follows: the plug 13 can be pushed down to the closed position by a thumb or other means. Once the plug 13 is at its lowest position and the top 20 of the plug 13 is flush with the top of the drain flange 16, the pin 34 is aligned with the slot 27 and hole complementary to the pin 34 in the portion 117. The operation of the fine spring 37 pushes the pin 34 through the slot 27 in to the complementary hole, holding the plug 13 in the closed position.

For the plug 13 to be moved from the closed position to the open position, the remote opening unit is operated in known manner to release the end pin 34 via the cabling 14. This operates to move the inner cable 40, and the pin 34 of the retaining mechanism back away from the centre of the plug 13. The head of the pin 34 retreats to rest within the slot 27 of the inter-engaging means. The spring 28 operates to raise the plug 13 up in the direction of arrow A. The bottom of the slot 27 operates against the pin 34 to retain the plug 13 from being released totally from the sink waste unit 11.

The component parts of the sink waste unit 11 and plug 13 are preferably of metals such as brass, brass alloys, stainless steel, or other metals or alloys appropriate for use in bathrooms/kitchens/waste fittings. Plastics materials may be used however, if so desired. The material or surface finish of the drain flange 16 and plug top 20 may be selected for visual appeal and a good finished appearance. If so desired, a shallow depression (eg thumb sized) may be shaped into the top 20 of the plug 13. Preferably this is positioned on the top 20 immediately over the slot 27.

Figure 2:
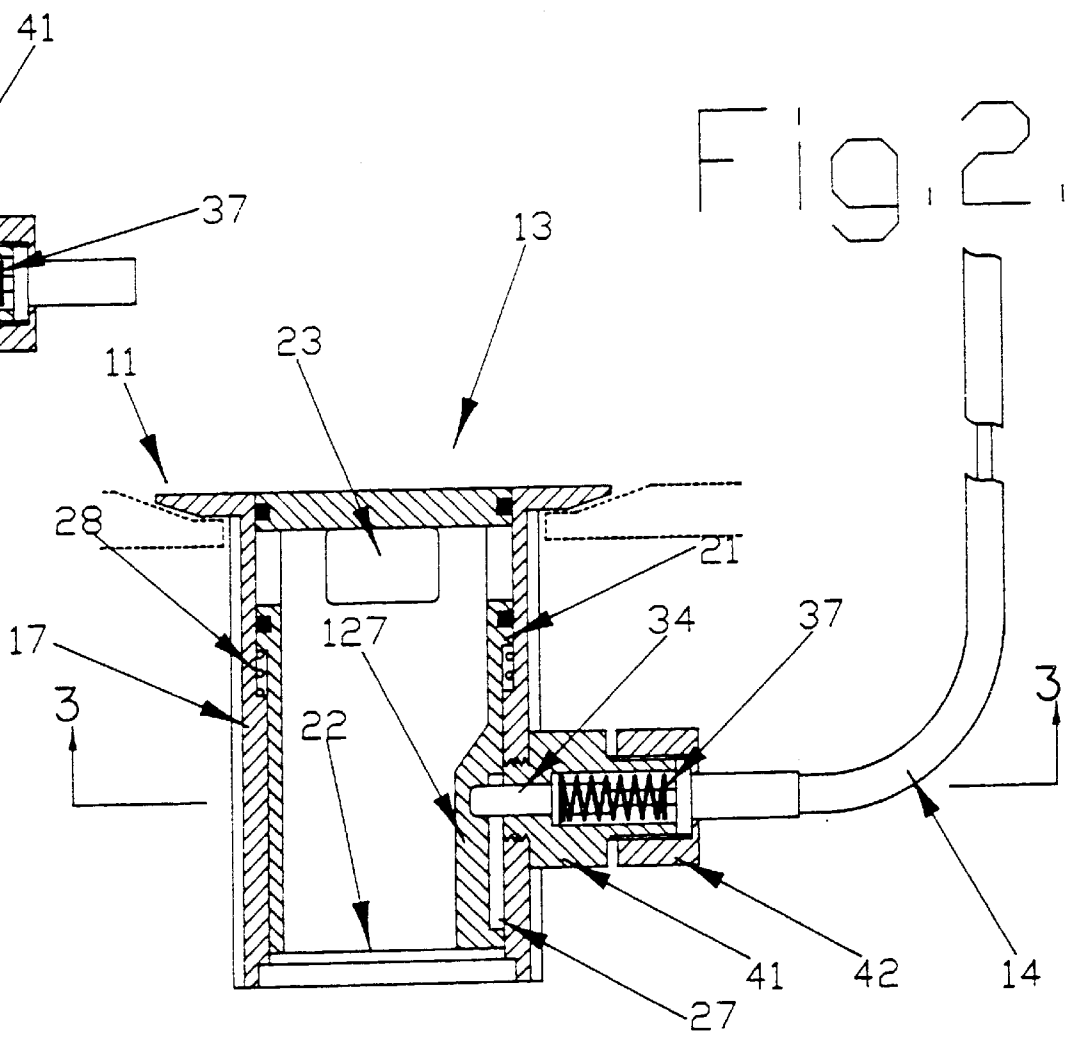
FIG. 2 is a section view of a remotely operated plug showing a second preferred embodiment of the present invention, with the plug in the closed position.
Figure 3:
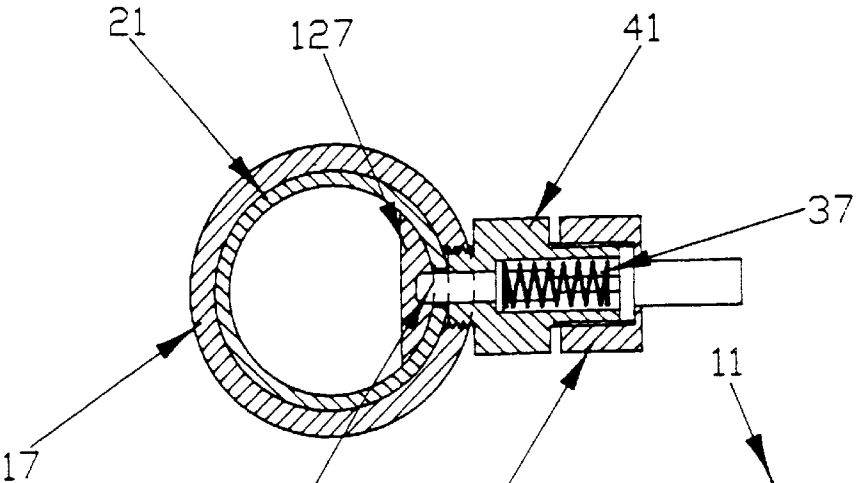
FIG. 3 is a section view along the line AA in FIG. 2.

A second preferred embodiment is shown in FIGS. 2 and 3. Like parts are numbered in like fashion. The major difference between the first and the second preferred embodiments is that in the second preferred embodiment the complementary hole in which the pin 34 sits when the plug 13 is closed forms part of a thickened wall 127 of the side wall 21 of the plug 13. The thickening 127 of the side wall 21 continues to the bottom 22 of the plug 13. Thus the interior of the drain unit, through which waste water flows, has a smooth change from one diameter to the second diameter (over the pin 34 and to the bottom 22 of the plug 13). However the manner of operation of the second preferred embodiment is identical with that of the first preferred embodiment of the present invention.

Additionally, the plug 13 has a second, offset slot (not shown) beside and adjacent and touching the slot 27. The second slot would be open to the bottom 22 of the plug 13. Thus a dog-leg slot would result.

Operation of the plug 13 to close the plug 13 would be as described above. However if the plug 13 is to be removed, the plug 13 is rotated (with the second pin 34 withdrawn from hole 18) so that the first pin 31 can move along the second offset slot to allow the plug 13 to be completely removed from the sink waste unit 11 (from above).

In respect of both embodiments it will be appreciated that the plug 13, along with the remote operation controls, can be fitted to an existing waste sink unit 11 with only minor modifications to the waste sink unit 11. Thus the plug 13 and remote operation controls may be sold separately.

In respect of both embodiments the spring 28 for retaining the plug 13 has been shown as shrouded. However it will be appreciated that the arrangement of the spring 28 may be as shown in PCT/NZ96/00031. Similarly, the pin spring 37 is shown as being adjacent the pin end of the cabling 41. However, it will be appreciated that this spring may operate at either end of the cabling 41.

We claim:

1. An improved remotely operated plug assembly for a sink or basin with a drain, said plug assembly including:

a sink waste unit secured within said drain, which sink waste unit includes a drain pipe;

a plug movably and releasably secured within said drain, said plug including a spring means, and an inter-engaging means, said plug having a closed top and sides with holes formed therein, wherein said plug is movably secured within the drain by said inter-engaging means which permits vertical movement of said plug within said drain, between an opened and a closed position and vice-versa, but which does not permit the removal of said plug from said drain under ordinary operating conditions, and said spring means serving to bias said plug to the open position, said open position being a position in which said holes are open to said sink or basin, and said closed position being a position in which said closed top is substantially flush with the top of said sink waste unit;

an opening mechanism to move the plug from the closed position to the open position, said mechanism being situated remotely from said drain and plug and connected by cabling to a retaining mechanism, said opening mechanism including an opening means to move and retain one end of said cabling;

said retaining mechanism, to keep said plug in the closed position, includes spring-biased means to release said retaining mechanism to allow said plug to move to the open position;

means to allow the plug to be physically removed from said drain and replaced therein; wherein the plug is capable of movement between an open and a closed position by manual depression of said plug, and between a closed and an open position by operation of said remotely placed opening mechanism to release the retaining mechanism via the cabling; and said inter-engaging means and said retaining mechanism have common elements which are circumferentially situated within and about said drain pipe, and wherein one element of said retaining mechanism is the said one end of said cabling of said opening mechanism.

2. An improved remotely operated plug assembly as claimed in claim 1 wherein said inter-engaging means and said retaining mechanism include:

a locating hole through the side of said drain pipe;

a portion of the lower half of the plug side over which the wall thickness of the side is greater than the remainder of the side of the plug, said portion containing a shaped longitudinal slot which does not extend through the thickness of the side, said plug being positioned such that the slot and the locating hole are capable of alignment;

a movable pin capable of location through said locating hole and slot and of being connected to one end of said cabling, the range of movement of the pin being less than the thickness of the thickened portion of the side of the plug; and a pin hole located within the side wall of the plug and at the top end of said slot, said pin hole being of a shape complementary to the end of the movable pin and positioned to receive the head therein when the plug is in the closed position; and wherein said pin retains said plug in the closed position by the operation of said spring-biassed means of the retaining mechanism to maintain said pin in said pin hole; and said pin retains the plug within the pipe by interaction of the pin with the bottom of the slot after said spring biassed means is operated and the spring means acts to push the plug to the open position.

3. The plug assembly as claimed in claim 2 wherein the side of the plug is dimpled about said pin hole, said dimple extending slightly beyond the side of the plug into the interior of the plug.

4. The plug assembly as claimed in claim 2 wherein the transition in the wall thickness of the side of the plug from the top of said portion to the bottom of the plug is smooth and gradual and the lower portion of the side wall of the plug has a constant interior cross-section.

5. The plug assembly as claimed in claim 1 wherein the parts of the plug assembly are made from materials selected from the group consisting of: brass; brass alloys; stainless steel, other metal alloys appropriate for use in bathroom fittings; plastics materials; and a combination thereof.

6. A plug for a sink or basin with a drain, said plug being remotely operated and being movably and releasably secured within a drain pipe, said sink waste unit including:

a plug with a closed top and sides with holes formed therein, said plug being movably secured within the drain by an inter-engaging means which permits vertical movement of said plug within said drain, between an opened and a closed position and vice-versa, but which does not permit the removal of said plug from said drain under ordinary operating conditions, and which incorporates spring means to bias said plug to the open position, said open position being a position in which said holes are open to said sink or basin, and said closed position being a position in which said closed top is substantially flush with the top of said sink waste unit;

an opening mechanism to move the plug from the closed position to the open position, said mechanism being situated remotely from said drain and plug and connected by cabling to a retaining mechanism, said opening mechanism including an opening means to move and retain one end of said cabling;

said retaining mechanism, to keep said plug in the closed position, includes spring-biased means to release said retaining mechanism to allow said plug to move to the open position;

means for enabling the plug to be physically removed from said drain and replaced therein; wherein the plug is capable of movement between an open and a closed position by manual depression of said plug, and between a closed and an open position by operation of said remotely placed opening mechanism to release the retaining mechanism via the cabling;

said inter-engaging means and said retaining mechanism have common elements which are circumferentially situated within said drain pipe and about said drain pipe, and wherein one element of said retaining mechanism is the said end of said cabling of said opening mechanism.

7. A plug as claimed in claim 6 wherein said inter-engaging means and said retaining mechanism include:

a locating hole through the side of said drain pipe;

a portion of the lower half of the plug side over which the wall thickness of the side is greater than the remainder of the side of the plug, said portion containing a shaped longitudinal slot which does not extend through the thickness of the side, said plug being positioned such that the slot and the locating hole are capable of alignment;

a movable pin capable of location through said locating hole and slot and of being connected to one end of said cabling, the range of movement of the pin being less than the thickness of the thickened portion of the side of the plug; and a pin hole located within the side wall of the plug and at the top end of said slot, said pin hole being of a shape complementary to the end of the movable pin and positioned to receive the head therein when the plug is in the closed position; and wherein said pin retains said plug in the closed position by the operation of said spring-biassed means of the retaining mechanism to maintain said pin in said pin hole; and said pin retains the plug within the pipe by interaction of the pin with the bottom of the slot after said spring biassed means is operated and the spring means acts to push the plug to the open position.

8. A plug as claimed in claim 7 wherein the side of the plug is dimpled about said pin hole, said dimple extending slightly beyond the side of the plug into the interior of the plug.

9. A plug as claimed in claim 7 wherein the transition in the wall thickness of the side of the plug from the top of said portion to the bottom of the plug is smooth and gradual and the lower portion of the side wall of the plug has a constant interior cross-section.

10. A plug as claimed in claim 7 wherein the parts of the plug assembly are made from materials selected from the group consisting of: brass; brass alloys; stainless steel, other metal alloys appropriate for use in bathroom fittings; plastics materials; and a combination thereof.

* * * * *